United States Patent [19]

Moormann et al.

[11] Patent Number: 4,737,128

[45] Date of Patent: Apr. 12, 1988

[54] FLEXIBLE UNITARY CIRCULAR AIR FOIL

[75] Inventors: Randall H. Moormann, Georgetown; Kevin A. Gillespie, Reading; James R. Henderson, Lincoln, all of Mass.

[73] Assignee: Parker Brothers Division of Kenner Parker Toys Inc., Beverly, Mass.

[21] Appl. No.: 940,738

[22] Filed: Dec. 11, 1986

[51] Int. Cl.[4] ..... A63B 65/10

[52] U.S. Cl. ..... 446/46; 273/424

[58] Field of Search ..... 446/46, 47; 273/362, 273/424

[56] References Cited

U.S. PATENT DOCUMENTS

| | | | |
|---|---|---|---|
| 3,099,450 | 7/1963 | Randall | 273/424 |
| 3,359,678 | 12/1967 | Headrick | 446/46 |
| 3,710,505 | 1/1973 | Linenfelser | 446/46 |
| 3,724,122 | 4/1973 | Gillespie, Jr. | 446/46 |
| 4,023,805 | 5/1977 | Sherrill | 446/46 |
| 4,135,325 | 1/1979 | Lehman | 446/46 |
| 4,157,631 | 6/1979 | Kifferstein et al. | 446/46 |
| 4,173,834 | 11/1979 | Kovac | 446/46 |
| 4,176,843 | 12/1979 | Dewitt, Jr. | 446/46 |
| 4,223,473 | 9/1980 | Brown | 446/46 |
| 4,241,533 | 12/1980 | Newsome | 446/46 |
| 4,351,129 | 9/1982 | Kerkenbush et al. | 446/46 |

*Primary Examiner*—Robert A. Hafer
*Assistant Examiner*—Samuel Rimell
*Attorney, Agent, or Firm*—Charles Hieken

[57] ABSTRACT

A flexible, circular, elastomer air foil that is a unitary structure has a central portion that droops downward when the foil is resting on a horizontal flat surface surrounded by an annular portion that is then convex on top and concave on the bottom when resting on a thicker perimetrical rim portion.

11 Claims, 3 Drawing Sheets

FLEXIBLE UNITARY CIRCULAR AIR FOIL

The present invention relates in general to circular air foils and more particularly concerns a novel, flexible air foil that is a unitary structure facilitating manufacture and convenient transportability while still providing good sailing characteristics with increased safety and acceptability for play.

A search of subclasses 46 and 48 of class 446 uncovered U.S. Pat. Nos. 4,223,473, 4,241,533, 4,253,269, 4,279,097, 4,290,226, 4,307,535, 4,378,653, 4,568,297 and British Patent No. 2,076,671. An additional search in subclass 200 of class 2, subclasses 127, 128, 344, 424-26 of class 273 and subclasses 26, 27 and 46–48 of class 446 uncovered U.S. Pat. Nos. 3,201,128, 4,115,946, 4,135,325, 4,196,540, 4,253,672 and 4,335,536.

Of these the most pertinent prior art appears to be U.S. Pat. No. 4,115,946. This patent teaches the use of nonresilient sheet material with weights connected to a laterally extending edge.

It is an important object of this invention to provide an improved flexible circular air foil.

According to the invention, the circular air foil is a one-piece structure made of a single piece of elastomeric resilient material throughout, such as natural or synthetic rubber, that is thicker at the periphery than inside the periphery with a portion inside the periphery sufficiently flexible so that when the foil rests on a flat surface, this internal or interior portion of the foil droops toward the flat surface. Also, the interior portion that droops downward when the foil is resting upon a horizontal surface is surrounded by an annular edge portion that is convex on top and concave on the bottom. The thickness of the interior portion is significantly less than the vertical height of the annular edge portion. The interior portion is between the flat or horizontal surface and a horizontal plane tangential to the maximum vertical height of the annular portion. The radius of the internal portion is greater than the width of the annular edge portion, whereby the foil may be folded, then unfolded and propelled while spinning to sail through the air with a pressure differential developing to cause the foil to be convex on top and concave below. A preferred material is natural rubber or other suitable elastomer.

Numerous other features, objects and advantages of the invention will become apparent from the following specification when read in connection with the accompanying drawing in which.

Figure 1:
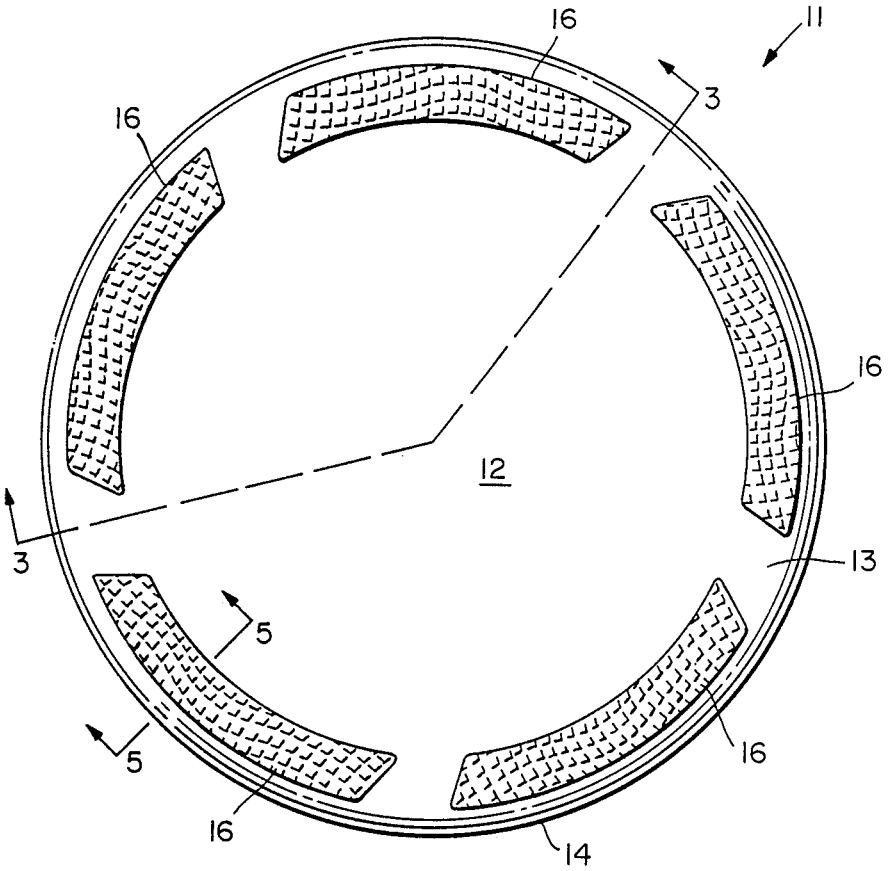
FIG. 1 is a plan view of an embodiment of the invention.
Figure 3:
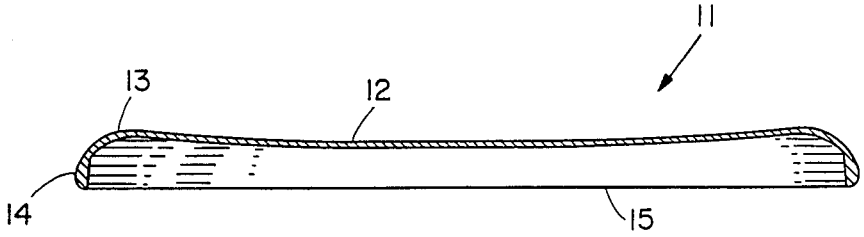
FIG. 3 is a view through section 3—3 of FIG. 1.

With reference now to the drawing and more particularly FIG. 1 thereof, there is shown a plan view of a foil 11 according to the invention. The foil 11 is preferably made of natural rubber or other suitable elastomer characterized by a material memory that restores the foil to its original size and shape after being folded. The foil is sufficiently flexible so that most of the portion inside the perimeter is portion 12 and droops downward toward the flat surface upon which its bottom edge 15 rests, best seen in FIG. 3. This portion is contiguous with the convex upward portion 13 between the edge 14 of the foil and the interior portion 12. There are textured sectors 16 in an annular region near the perimeter that facilitate gripping the foil. FIG. 3 is a view through section 3—3 of FIG. 1 and shows these relations. The radius of the downwardly dropping portion 12 is of the order of three times the width of the upwardly convex portion 13, and preferably at least greater than the width of portion 13. The portion of the foil immediately adjacent to edge 14 is thicker than the remainder of the foil.

Figure 2:
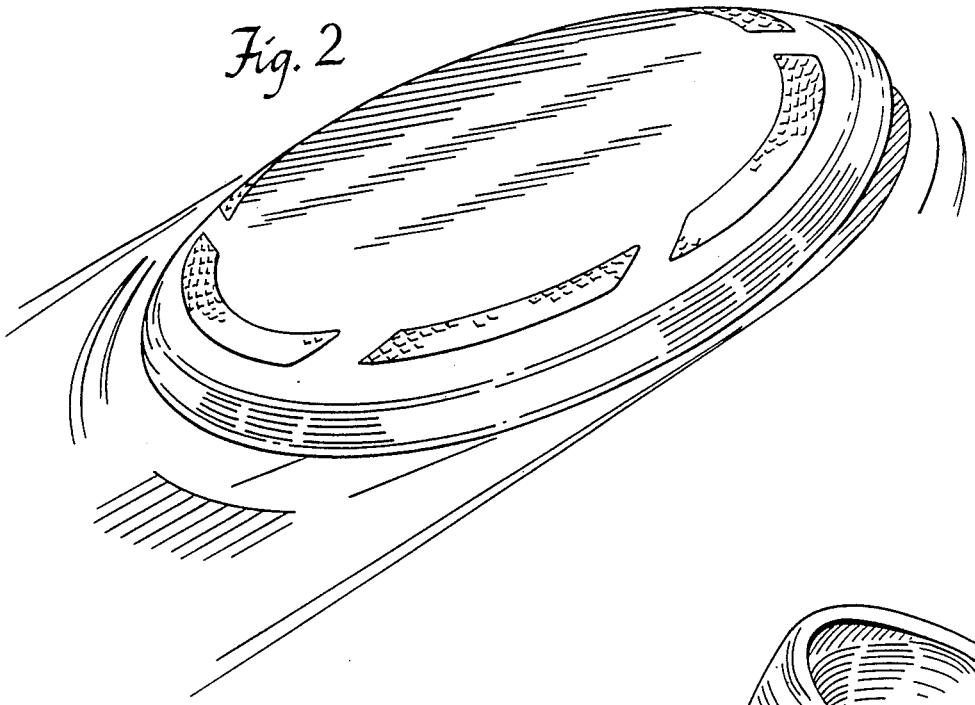
FIG. 2 is a perspective view of the invention in flight.
Figure 4:
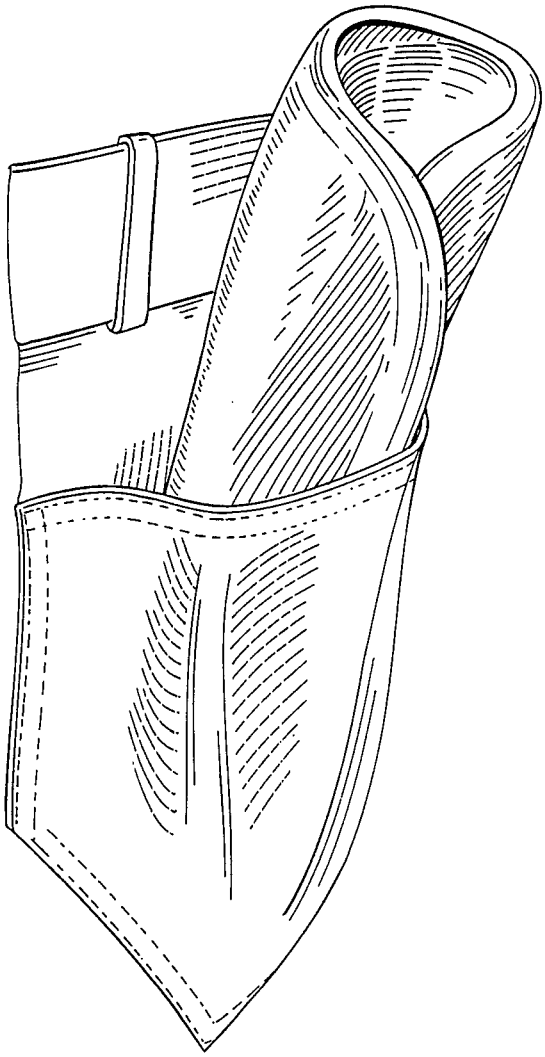
FIG. 4 shows the foil folded for storage in a purse or pocket.

Referring to FIG. 2, there is shown a perspective view of the foil in flight. In flight the spinning motion and movement through the air creates a pressure differential tending to lift the inner portion 12 and form a smooth air foil promoting lift and smooth sailing through the air, in which case the airfoil becomes convex on top and concave below. Yet, the foil is sufficiently flexible so that it may be folded as shown in FIG. 4 for storage in a pocket or purse.

Figure 5:
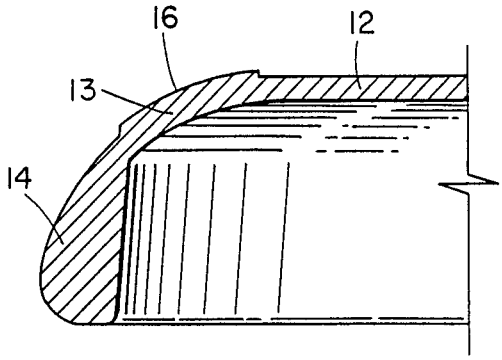
FIG. 5 is a view through section 5—5 of FIG. 1 showing the thicker wall at the perimeter.

FIG. 5 is a view through section 5—5 of FIG. 1 showing the wall thickness at the perimeter, typically 0.187", three times greater than at the interior portion, typically 0.060".

A suitable form of resilient material is an elastomer, such as natural or synthetic rubber and durometer 30–70, preferably 45±5%. In an exemplary embodiment of the invention the diameter of foil 11 was 8 inches and the weight 90 grams. This embodiment was easy to sail by spinning and projecting the foil in the desired direction. It could be easily folded and placed in a pocket. When removed from the pocket, it assumed the form shown in FIG. 1.

There has been described novel apparatus and techniques for providing a flexible air foil that is relatively easy and inexpensive to fabricate and use while minimizing the chances of damage to people and property and being easily transportable. The invention is tactile to facilitate catching by unskilled people, such as children. The resiliency of the invention results in reduced apprehension by players and increased willingness to catch the spinning foil.

It is evident that those skilled in the art may now make numerous uses and modifications of and departures from the specific embodiments described herein without departing from the inventive concepts. Consequently, the invention is to be construed an embracing each and every novel feature and novel combination of features present in or possessed by the apparatus and techniques herein disclosed and limited solely by the spirit and scope of the appended claims.

What is claimed is:

1. A flexible, circular air foil that is a one-piece structure made of a single-piece of resilient elastomeric material throughout and further comprising, an interior portion that droops downward when said foil is resting upon a horizontal surface surrounded by an annular edge portion that is convex on top and concave on the bottom, the thickness of said interior portion being significantly less than the vertical height of the annular edge portion, said interior portion being between said horizontal surface and a horizontal plane tangential to the maximum vertical height of said annular portion, the radius of said interior portion being greater than the width of said annular edge portion, whereby said foil being sufficiently elastomeric so that it may be folded, then unfolded and propelled while spinning to sail through the air with a pressure differential developing to cause the foil to be convex on top and concave below.

2. A flexible circular air foil that is a unitary structure made of resilient material in accordance with claim 1 wherein said resilient material has a durometer within the range of 30–70.

3. A flexible circular air foil in accordance with claim 2 wherein said durometer is within a range of 5% of 45.

4. A flexible circular air foil in accordance with claim 3 wherein said circular air foil has a diameter of substantially 8 inches and weighs substantially within 5 grams of 85 grams.

5. A flexible circular air foil in accordance with claim 1 wherein the wall thickness at the perimeter of said air foil is thicker than the wall thickness inside said perimeter.

6. A flexible circular air foil in accordance with claim 2 wherein the wall thickness at the perimeter of said air foil is thicker than the wall thickness inside said perimeter.

7. A flexible circular air foil in accordance with claim 3 wherein the wall thickness at the perimeter of said air foil is thicker than the wall thickness inside said perimeter.

8. A flexible circular air foil in accordance with claim 4 wherein the wall thickness at the perimeter of said air foil is thicker than the wall thickness inside said perimeter.

9. A flexible circular air foil in accordance with claim 8 wherein the thickness of said perimeter wall has a maximum thickness substantially three times the wall thickness of said interior portion.

10. A flexible circular air foil in accordance with claim 9 wherein said maximum perimeter wall thickness is substantially 0.187" and that of said interior portion is substantially 0.060".

11. A flexible circular air foil in accordance with claim 1 and further comprising an annular region near said annular edge portion having textured portions.

* * * * *